US012305913B2

(12) United States Patent
Yun et al.

(10) Patent No.: US 12,305,913 B2
(45) Date of Patent: May 20, 2025

(54) REFRIGERATOR

(71) Applicant: SAMSUNG ELECTRONICS CO., LTD., Suwon-si (KR)

(72) Inventors: Subin Yun, Suwon-si (KR); Inyong Hwang, Suwon-si (KR); Chulhee Kim, Suwon-si (KR); Seongchan Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 208 days.

(21) Appl. No.: 18/151,241

(22) Filed: Jan. 6, 2023

(65) Prior Publication Data

US 2024/0077248 A1 Mar. 7, 2024

(30) Foreign Application Priority Data

Sep. 2, 2022 (KR) ..... 10-2022-0111537

(51) Int. Cl.
*F25D 11/02* (2006.01)
*F25D 23/06* (2006.01)

(52) U.S. Cl.
CPC ..... *F25D 23/069* (2013.01); *F25D 23/066* (2013.01); *F25D 11/02* (2013.01); *F25D 23/065* (2013.01); *F25D 2201/122* (2013.01); *F25D 2400/04* (2013.01); *F25D 2400/16* (2013.01)

(58) Field of Classification Search
CPC .... F25D 23/065; F25D 23/066; F25D 23/069; F25D 2400/04; F25D 2400/16; F25D 2201/122; F25D 2201/126; F25D 11/02
See application file for complete search history.

(56) References Cited

U.S. PATENT DOCUMENTS 9,945,600 B2 4/2018 Kang
2003/0167789 A1* 9/2003 Tanimoto ..... B65D 81/18 220/592.27
2014/0015394 A1* 1/2014 Cha ..... F25D 11/02 312/404
2014/0033759 A1* 2/2014 Ide ..... F25D 23/062 62/457.2
2017/0176093 A1* 6/2017 Kang ..... F25D 23/066
2018/0087824 A1* 3/2018 Han ..... F25D 23/069
(Continued)

FOREIGN PATENT DOCUMENTS

CN 206449970 U * 8/2017
JP H0726678 U 5/1995
(Continued)

*Primary Examiner* — Kimberley S Wright

(57) ABSTRACT

A refrigerator is provided. The refrigerator includes: an outer case forming an exterior of the refrigerator; an inner case disposed inside the outer case, forming a storage compartment therein, and having a communication hole formed through a side surface thereof; a partition supported by the inner case to partition the storage compartment, and including a heat insulator inlet at a position corresponding to the communication hole; and a heat insulator filled between the outer case and the inner case and filled into the partition through the heat insulator inlet, wherein the partition includes a first vertical partitioning wall disposed between the outer case and the inner case and having a height to limit a size of the heat insulator inlet.

17 Claims, 6 Drawing Sheets

(56) References Cited

U.S. PATENT DOCUMENTS

| | | | | |
|---|---|---|---|---|
| 2018/0224201 | A1* | 8/2018 | Cha | F25D 11/02 |
| 2022/0397330 | A1* | 12/2022 | Yang | F25D 11/02 |

FOREIGN PATENT DOCUMENTS

| | | | |
|---|---|---|---|
| JP | 3540571 | B2 | 7/2004 |
| JP | 2005257087 | A | 9/2005 |
| JP | 6877223 | B2 | 5/2021 |
| KR | 10-1314135 | B1 | 10/2013 |
| KR | 10-2016-0143190 | A | 12/2016 |
| KR | 10-1870509 | B1 | 6/2018 |

* cited by examiner

REFRIGERATOR

CROSS-REFERENCE TO RELATED APPLICATION

This application is based on and claims priority under 35 U.S.C. § 119 to Korean Patent Application No. 10-2022-0111537, filed Sep. 2, 2022, the disclosures of which are herein incorporated by reference in their entirety.

BACKGROUND

1. Field

Apparatuses and methods consistent with the disclosure relate to a refrigerator, and more particularly, to a refrigerator having a partitioning wall structure in which a heat insulator inlet of a partition is improved to prevent deformation of an outer case caused due to shrinkage of a heat insulator.

2. Description of the Related Art

A refrigerator is a device including a storage compartment, and a cold air supply device for supplying cold air to the storage compartment to keep food fresh. The storage compartment is kept at a temperature within a predetermined range required to keep food fresh. An inner case of the refrigerator forms a storage compartment therein, and an outer case of the refrigerator is coupled to an external side of the inner case to form an exterior of the refrigerator. The partition of the refrigerator partitions the storage compartment into multiple spaces. The heat insulator is filled between the inner case and the outer case to prevent a leakage of cold air.

SUMMARY

Embodiments of the disclosure overcome the above disadvantages and other disadvantages not described above. Also, the disclosure is not required to overcome the disadvantages described above, and an embodiment of the disclosure may not overcome any of the problems described above.

The disclosure provides a refrigerator having a partitioning wall structure in which a heat insulator inlet of a partition disposed in the refrigerator is improved.

According to an embodiment of the disclosure, a refrigerator includes: an outer case forming an exterior of the refrigerator; an inner case disposed inside the outer case, forming a storage compartment therein, and including a communication hole formed through a side surface thereof; a partition supported by the inner case and configured to partition the storage compartment, and including a heat insulator inlet at a position aligned with the communication hole; and a heat insulator filled between the outer case and the inner case and filled into the partition through the heat insulator inlet. The partition may include a first vertical partitioning wall disposed between the outer case and the inner case and having a height to limit a size of the heat insulator inlet.

The size of the heat insulator inlet may be in inverse proportion to the height of the first vertical partitioning wall.

A thickness of a first portion of the heat insulator disposed between the first vertical partitioning wall and the outer case may be smaller than a thickness of a second portion of the heat insulator disposed between the outer case and the inner case.

The partition may include a first protrusion protruding horizontally from a side surface thereof through the communication hole to connect to a lower end of the first vertical partitioning wall.

The first vertical partitioning wall may be formed to extend upward from the first protrusion, with a free end at the upper end thereof.

The partition may further include a second vertical partitioning wall disposed on an opposite side of the communication hole from the first vertical partitioning wall to correspond to an upper area of the heat insulator inlet, with a free end at a lower end thereof.

A lower end portion of the second vertical partitioning wall may extends past an upper end portion of the first vertical partitioning wall in a vertical direction.

The lower end portion of the second vertical partitioning wall may extend past the upper end portion of the first vertical partitioning wall by 2 mm or more.

The partition may further include a second protrusion protruding horizontally from a side surface thereof through the communication hole, and disposed above the first vertical partitioning wall to form the heat insulator inlet together with the first vertical partitioning wall.

The partition may further include a support rib protruding downward from the second protrusion to support an inner surface of the first vertical partitioning wall.

The support rib may include a plurality of support ribs spaced apart from each other along a thickness direction of the second protrusion.

The partition may include: a lower cover including the first vertical partitioning wall; and an upper cover forming an internal space of the partition together with the lower cover.

The partition may further include a reinforcing member coupled to the lower cover and the upper cover, the reinforcing member including a second vertical partitioning wall with a free end at a lower end thereof at an opposite side of the heat insulator from the first vertical partitioning wall.

The reinforcing member may be disposed to surround a partial portion of side surface of the upper cover and the lower cover around the heat insulator inlet to connect the upper cover and the lower cover to each other.

The reinforcing member may include a through hole at a position corresponding to the communication hole.

The partition may further include a heat insulating member disposed between the upper cover and the lower cover.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

The above and/or other aspects of the disclosure will be more apparent by describing certain embodiments of the disclosure with reference to the accompanying drawings, in which.

DETAILED DESCRIPTION

FIGS. 1 through 6, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Embodiments to be described below are exemplary to help understanding of the disclosure, and it is to be understood that the disclosure may be modified in various manners unlike the embodiments described herein. However, in describing the disclosure, if it is determined that a detail description of a relevant known function or component may unnecessarily obscure the gist of the disclosure, the detailed description and concrete illustration thereof will be omitted. Further, to help understanding of the disclosure, the accompanying drawings are not necessarily illustrated to an actual scale, but dimensions of some components may be exaggerated.

The terms used in the specification and the claims are general terms selected in consideration of the functions of the disclosure. However, these terms may vary depending on intentions of those skilled in the art, legal or technical interpretation, emergence of new technologies, and the like. Also, there may be some terms arbitrarily selected by the applicant. These terms may be construed as meanings defined in the specification and, unless explicitly defined, may be construed based on the entire contents of the specification and the common technical knowledge in the art.

In the specification, the expressions "have", "may have", "include", "may include", and the like indicate the presence of corresponding features (e.g., numerical values, functions, operations, or components such as parts), and do not preclude the presence of additional features.

In the specification, components necessary in describing each embodiment of the disclosure are described, and the components are not necessarily limited thereto. Therefore, some of the components may be modified or omitted, and other components may be added. In addition, the components may also be dispersedly arranged in devices independent from each other.

Furthermore, although embodiments of the disclosure will be described in detail below with reference to the accompanying drawings and the contents described in the accompanying drawings, the disclosure is not limited by the embodiments.

Hereinafter, the disclosure will be described in more detail with reference to the accompanying drawings.

Figure 1:
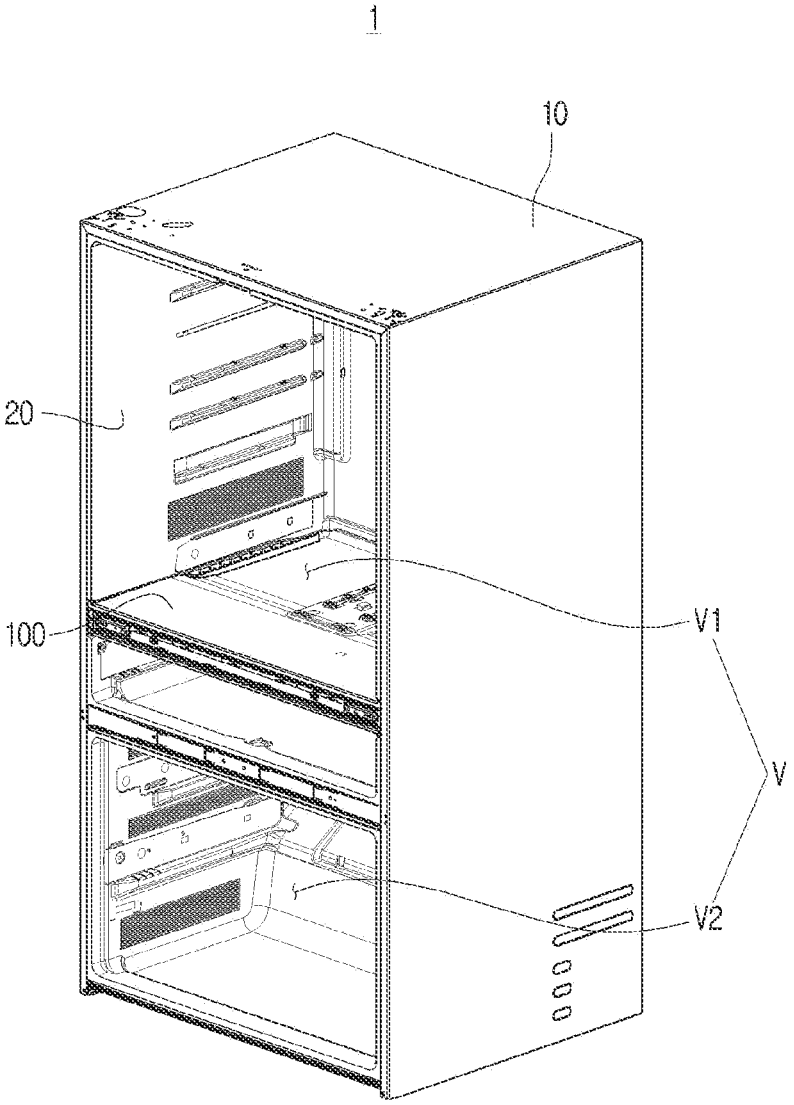
FIG. 1 is a perspective view of a refrigerator according to an embodiment of the disclosure.
Figure 2:
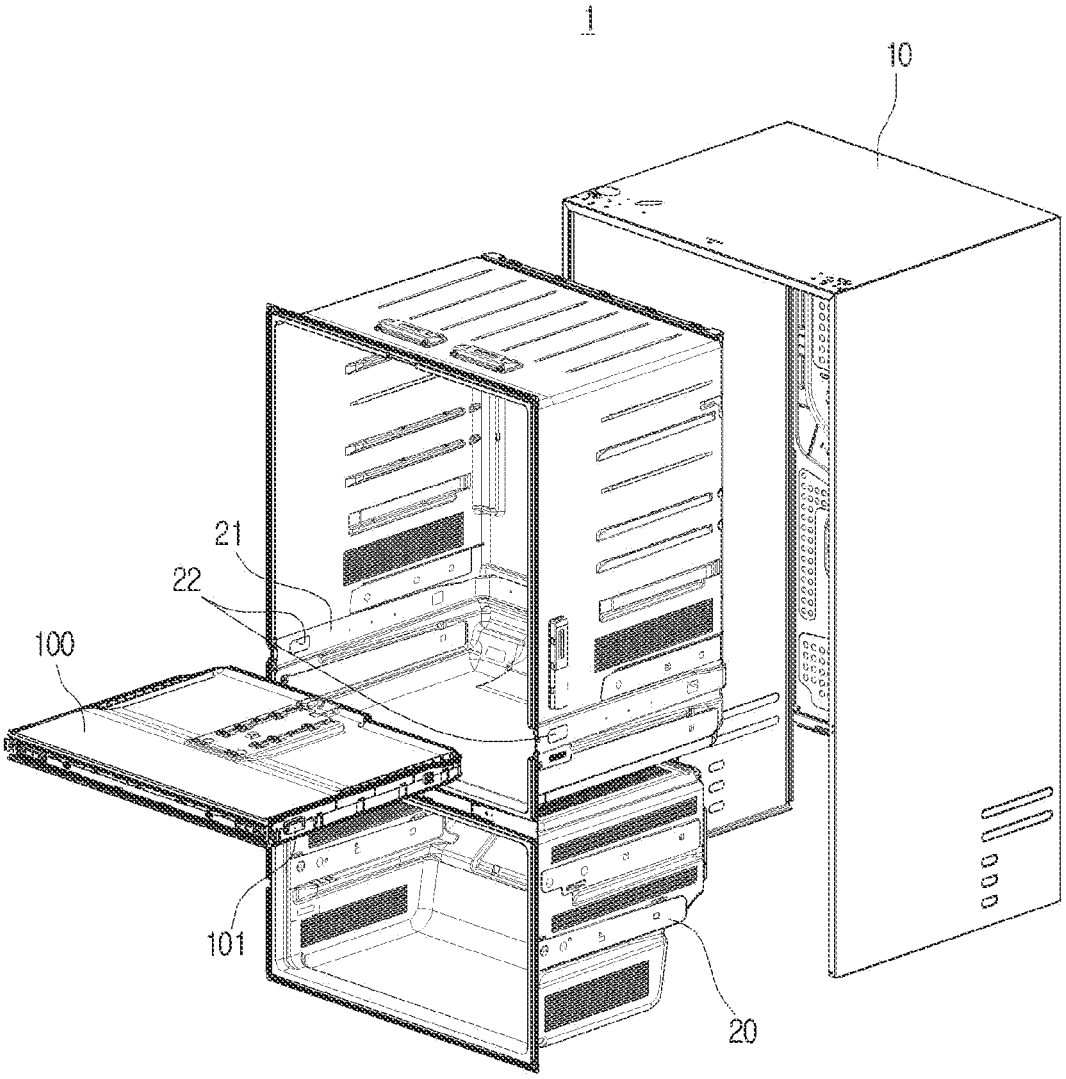
FIG. 2 is an exploded perspective view of the refrigerator of FIG. 1.

FIG. 1 is a perspective view of a refrigerator according to an embodiment of the disclosure. FIG. 2 is an exploded perspective view of the refrigerator of FIG. 1.

Referring to FIGS. 1 and 2, a refrigerator 1 according to an embodiment of the disclosure may include an outer case 10, an inner case 20, a partition 100, and a heat insulator (not shown).

The outer case 10 may form an exterior of the refrigerator 1. The inner case 20 may be disposed inside the outer case 10 and form a storage compartment V therein.

The inner case 20 may include a groove 21 supporting the partition 100 in an inner wall thereof. The groove 21 may be provided on both side surfaces and a rear surface of the inner wall of the inner case 20. The partition 100 may be inserted into the inner case 20 along the groove 21 of the inner case 20 and supported by the inner case 20.

The inner case 20 may include a communication hole 22 formed through the side surface thereof. The communication hole 22 may be disposed in the groove 21 of the inner case 20. The communication hole 22 may be a passage through which the heat insulator can be filled into the partition 100.

The partition 100 may be supported by the inner case 20 to partition the storage compartment V. The partition 100 may be disposed in the groove 21 of the inner case 20. The partition 100 may partition the storage compartment V into a first storage compartment V1 and a second storage compartment V2. The first storage compartment V1 may be a refrigerating chamber and the second storage compartment V2 may be a freezing chamber, but the use of each of the storage compartments is not limited thereto.

The partition 100 may include a heat insulator inlet 101 at a position corresponding to the communication hole 22 of the inner case 20. The heat insulator may move into the partition 100 through the heat insulator inlet 101.

The heat insulator (not shown) may be filled between the outer case 10 and the inner case 20. In addition, the heat insulator may be filled into the partition 100 through the heat insulator inlet 101.

That is, the heat insulator may be filled between the outer case 10 and the inner case 20 through a hole formed in the outer case 10, and filled into the partition 100 through the communication hole 22 of the inner case 20 and the heat insulator inlet 101. The heat insulator may be formed of urethane, and may be filled while expanding through a foaming process.

Figure 3:
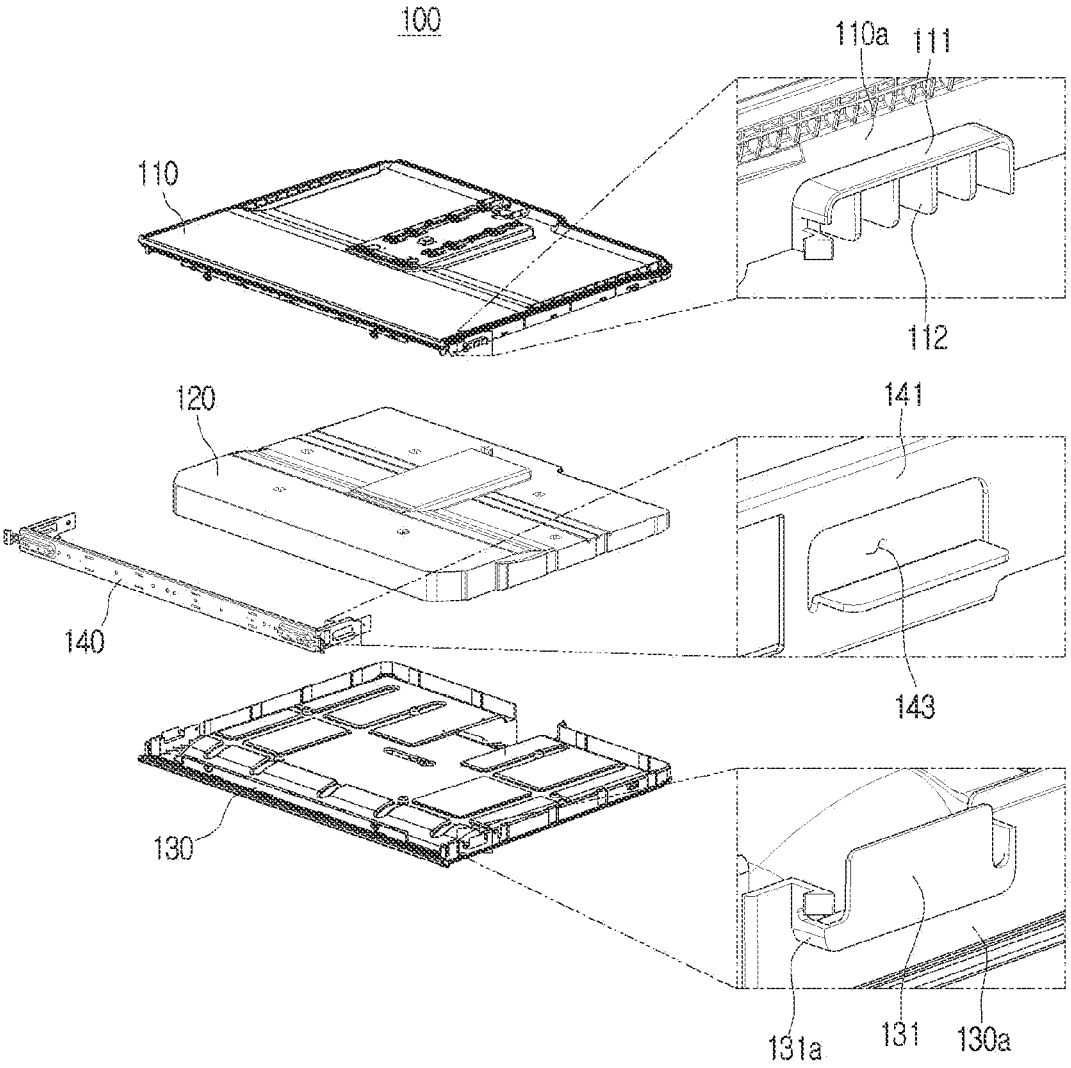
FIG. 3 is an exploded perspective view of a partition according to an embodiment of the disclosure.
Figure 4:
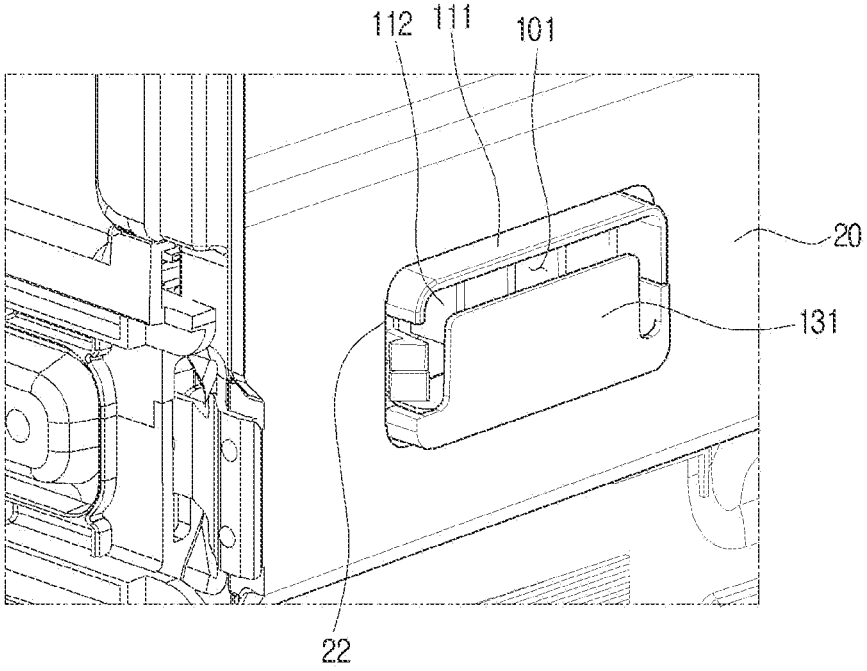
FIG. 4 is a perspective view illustrating a heat insulator inlet of the partition.
Figure 5:
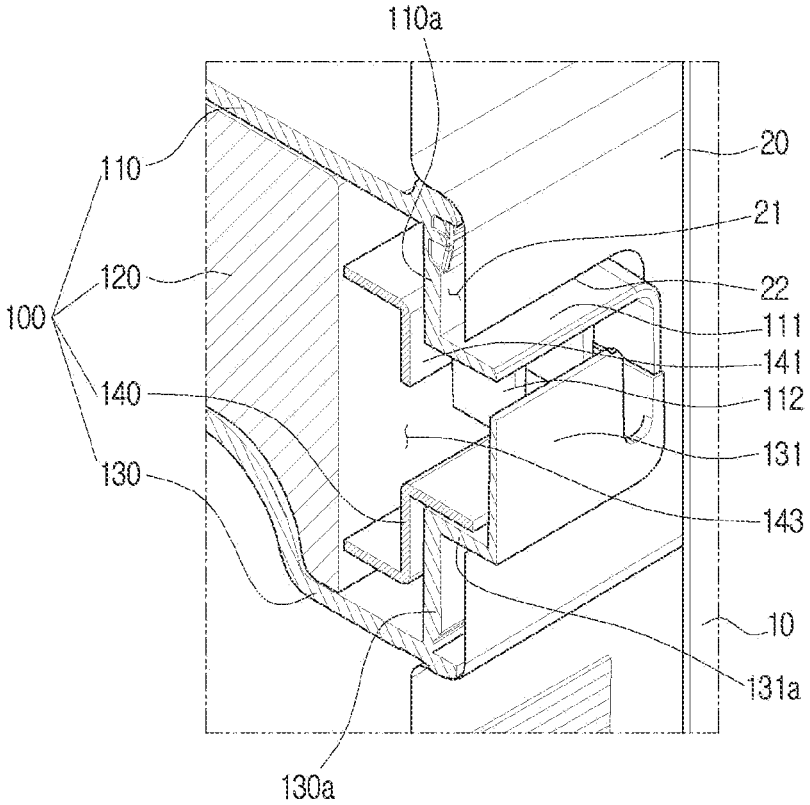
FIG. 5 is a cross-sectional perspective view illustrating a partitioning wall structure of the partition.
Figure 6:
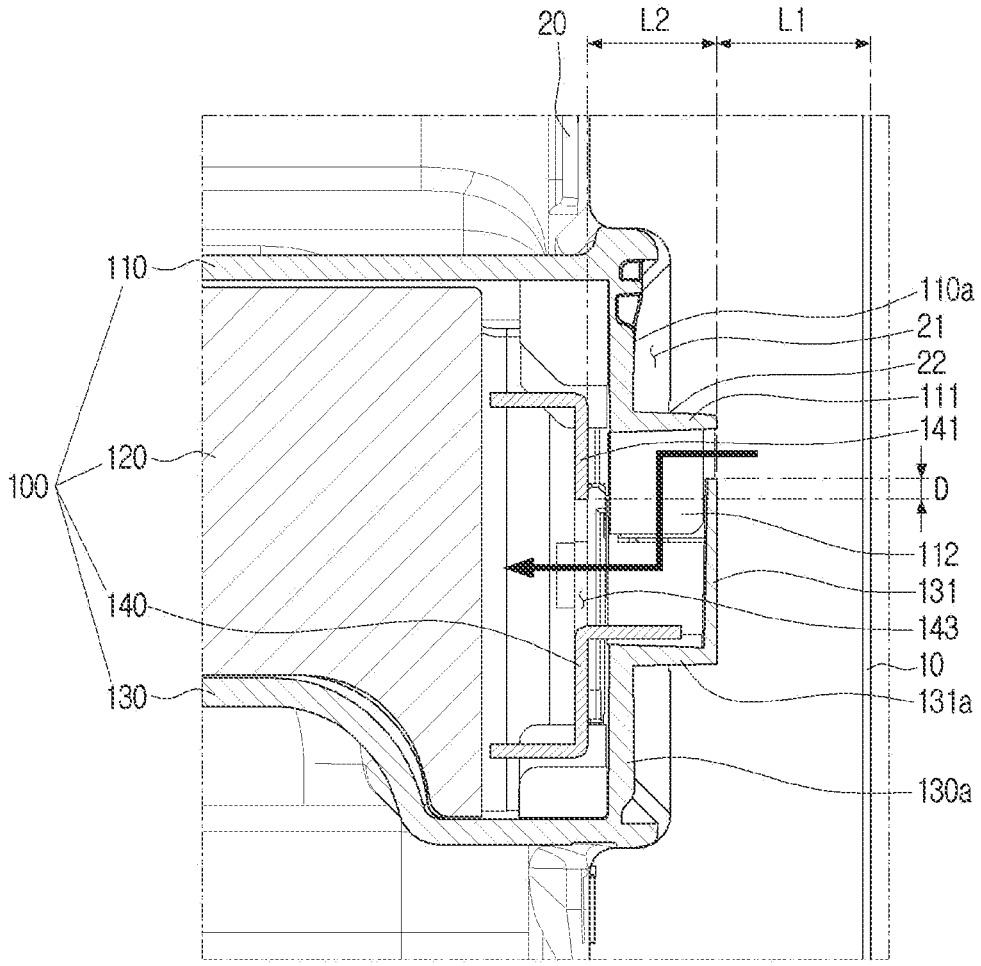
FIG. 6 is a cross-sectional view illustrating the partitioning wall structure of the partition.

FIG. 3 is an exploded perspective view of the partition according to an embodiment of the disclosure. FIG. 4 is a perspective view illustrating the heat insulator inlet of the partition. FIG. 5 is a cross-sectional perspective view illustrating a partitioning wall structure of the partition. FIG. 6 is a cross-sectional view illustrating the partitioning wall structure of the partition.

Referring to FIGS. 3 to 6, the partition 100 according to an embodiment of the disclosure may include a first vertical partitioning wall 131.

The first vertical partitioning wall 131 may have a predetermined height to limit a size of the heat insulator inlet 101. For example, increasing the height of the first vertical partitioning wall 131 decreases the size of the heat insulator inlet 101, and decreasing the height of the first vertical partitioning wall 131 increases the size of the heat insulator inlet 101. As such, the height of the first vertical partitioning wall 131 and the size of the heat insulator inlet 101 may be in inverse proportion to each other.

The heat insulator may be filled into the partition 100 through the communication hole 22 of the inner case 20 and the heat insulator inlet 101. In this case, the heat insulator may fill an internal space of the partition 100 other than a portion occupied by a heat insulating member 120 (see FIG. 5), which will be described below.

Also, the heat insulator may be filled between the first vertical partitioning wall 131 and the outer case 10. As the size of the heat insulator inlet 101 decreases, a height of an extending portion of the heat insulator connected through the heat insulator inlet 101 to a partial portion of the heat insulator formed between the first vertical partitioning wall 131 and the outer case 10 may be minimized. Accordingly, because the effect of the extending portion of the heat insulator on the shrinkage of the partial portion of the heat insulator is insignificant, it is possible to reduce a load generated by the shrinkage of the heat insulator, and it is also possible to prevent the outer case 10 contacting the heat insulator from being deformed.

When the heat insulator inlet 101 is formed to have a small size by the first vertical partitioning wall 131 as illustrated in FIG. 6, a thickness of the heat insulator filled between the first vertical partitioning wall 131 and the outer case 10 may approximately correspond to L1, which is a distance between the first vertical partitioning wall 131 and the outer case 10.

By reducing the size of the heat insulator inlet 101 using the first vertical partitioning wall 131, a thickness of the heat insulator disposed between the first vertical partitioning wall 131 and the outer case 10 may be smaller than a thickness of the other portion of the heat insulator disposed between the inner case 20 and the outer case 10. When a temperature of the inner case 20 decreases, the heat insulator may shrink due to thermal deformation. For example, an amount of shrinkage of the heat insulator may be proportional to an original length of the heat insulator. In this case, the thickness of the heat insulator reduced to approximately correspond to L1 by the first vertical partitioning wall 131, making it possible to minimize an amount of shrinkage of the heat insulator, thereby minimizing a deformation of the outer case 10 caused due to the shrinkage of the heat insulator.

The first vertical partitioning wall 131 may be disposed between the outer case 10 and the inner case 20. That is, the first vertical partitioning wall 131 may protrude from the partition 100 to be disposed through the communication hole 22 of the inner case 20.

As a result, the first vertical partitioning wall 131 makes it possible to reduce the thickness of the heat insulator to L1, which is smaller than the distance between the outer case 10 and the inner case 20.

The partition 100 according to an embodiment of the disclosure may include a first protrusion 131*a*. The first protrusion 131*a* may protrude horizontally from a side surface of the partition 100 through the communication hole 22 to a lower end of the first vertical partitioning wall 131.

That is, the first protrusion 131*a* may pass through the communication hole 22 of the inner case 20, so that one end of the first protrusion 131*a* extends from the side surface of the partition 100 and the lower end of the first vertical partitioning wall 131 extends from the other end of the first protrusion 131*a*.

The first vertical partitioning wall 131 may be formed to extend upward from the first protrusion 131*a*, with an upper end of the first vertical partitioning wall 131 being a free end. That is, the first vertical partitioning wall 131 may block a lower area of the heat insulator inlet 101 of the partition 100 with an upper area of the heat insulator inlet 101 of the partition 100 remaining open or unblocked by the first vertical partitioning wall 131. Accordingly, the heat insulator may be filled into the partition 100 through the upper area of the heat insulator inlet 101, which is not blocked by the first vertical partitioning wall 131.

The partition 100 according to an embodiment of the disclosure may further include a second vertical partitioning wall 141, with a lower end thereof being a free end, on an opposite side of the communication hole 22 from the first vertical partitioning wall 131. The second vertical partitioning wall 141 may be disposed in parallel to the first vertical partitioning wall 131. The second vertical partitioning wall 141 may be disposed on an opposite side of the communication hole 22 from the first vertical partitioning wall 131. The second vertical partitioning wall 141 may be disposed at a position corresponding to the upper area of the heat insulator inlet 101.

Accordingly, the thickness of the heat insulator corresponding to the upper area of the heat insulator inlet 101 in the horizontal direction may be reduced to L1+L2, thereby minimizing an amount of shrinkage of the heat insulator and a deformation of the outer case 10.

A lower end portion of the second vertical partitioning wall 141 may overlap an upper end portion of the first vertical partitioning wall 131 by a predetermined length D (see FIG. 6) in a vertical direction. Accordingly, the heat insulator may be filled into the partition 100 along a curved path rather than a straight path.

That is, due to the overlap structure between the first vertical partitioning wall 131 and the second vertical partitioning wall 141, no straight portion is formed in the heat insulator in the horizontal direction from the outer case 10 to the inside of the partition 100. Therefore, a thickness of the heat insulator contacting the outer case 10 is reduced as compared with that in the conventional art, and a load caused by thermal shrinkage of the heat insulator is reduced, resulting in a decrease in amount of deformation of the outer case 10.

The lower end portion of the second vertical partitioning wall 141 may overlap the upper end portion of the first vertical partitioning wall 131 by 2 mm or more. However, the length D (see FIG. 6) by which the first and second vertical partitioning walls 131 and 141 overlap each other is not limited thereto, and may be 1 mm or more and 5 mm or less.

The partition 100 according to an embodiment of the disclosure may further include a second protrusion 111. The second protrusion 111 may protrude horizontally from the side surface 110*a* of the partition 100 through the communication hole 22, and may be disposed above the first vertical partitioning wall 131 to form the heat insulator inlet 101 together with the first vertical partitioning wall 131.

That is, the heat insulator may pass between the second protrusion 111 and the upper end of the first vertical partitioning wall 131 to be filled into the partition 100. In this case, the heat insulator inlet 101 may refer to a space between the second protrusion 111 and the first vertical partitioning wall 131.

The partition 100 according to an embodiment of the disclosure may include a support rib 112. The support rib 112 may protrude downward from the second protrusion 111 to support an inner surface of the first vertical partitioning wall 131.

Accordingly, when the first vertical partitioning wall 131 is pressed inwardly while the heat insulator is filled into the partition 100, the support rib 112 safely supports the first vertical partitioning wall 131 outwardly, making it possible to prevent the first vertical partitioning wall 131 from deforming.

The support rib 112 may include a plurality of support ribs 112 spaced apart from each other along a thickness direction of the second protrusion 111. The thickness direction of the second protrusion 111 may refer to a front-rear direction perpendicular to a direction in which the heat insulator is filled. The plurality of support ribs 112 may stably support the first vertical partitioning wall 131 so that the first vertical partitioning wall 131 is not deformed. At this time, the heat insulator may be filled into the partition 100 by passing through a space between the plurality of the support ribs 112.

For example, the partition 100 according to an embodiment of the disclosure may include an upper cover 110, a heat insulating member 120, a lower cover 130, and a reinforcing member 140. The upper cover 110 and the lower cover 130 may together form an internal space of the partition 100 into which the heat insulator is to be filled.

The first vertical partitioning wall 131 described above may be included in the lower cover 130. The lower cover 130 may include a first protrusion 131*a* protruding horizontally from a side surface 130*a* thereof through the communication hole 22 of the inner case 20. One end of the first protrusion 131*a* may be connected to the side surface 130*a* of the lower cover 130, and the other end of the first protrusion 131*a* may be connected to the lower end of the first vertical partitioning wall 131. The first vertical partitioning wall 131 may extend upward from the first protrusion 131*a*, with an upper end thereof being a free end.

Because the thickness of the heat insulator in the horizontal direction is reduced to L1 by the first vertical partitioning wall 131, it is possible to minimize an amount of shrinkage of the heat insulator and deformation of the outer case 10.

The partition 100 according to an embodiment of the disclosure may further include a reinforcing member 140. The reinforcing member 140 may be coupled to the lower cover 130 and the upper cover 110, and may include a second vertical partitioning wall 141. The second vertical partitioning wall 141 may be formed on an opposite side of the communication hole from the first vertical partitioning wall 131, with a lower end thereof being a free end. The reinforcing member 140 may be connected to a door hinge part (not shown) that rotatably connects a door (not shown) of the refrigerator 1 and the inner case 20.

The second vertical partitioning wall 141 of the reinforcing member 140 may be disposed at a position corresponding to the upper area of the heat insulator inlet 101, which is not blocked by the first vertical partitioning wall 131. Accordingly, because the thickness of the heat insulator corresponding to the upper area of the heat insulator inlet 101 in the horizontal direction is reduced to L1+L2, it is possible to minimize an amount of shrinkage of the heat insulator and deformation of the outer case 10.

The reinforcing member 140 may be disposed to surround a partial portion of the side surface of the partition 100 to connect the upper cover 110 and the lower cover 130 to each other. Accordingly, the reinforcing member 140 may increase an overall rigidity of the partition 100.

The reinforcing member 140 may include a through hole 143 at a position corresponding to the communication hole 22. That is, the heat insulator may be filled into the partition 100 by sequentially passing through the heat insulator inlet 101, the communication hole 22 of the inner case 20, and the through hole 143 of the reinforcing member 140.

The partition 100 may further include a heat insulating member 120. The heat insulating member 120 may be disposed between the upper cover 110 and the lower cover 130. The heat insulating member 120 may be formed of expanded polystyrene (EPS). That is, the heat insulating member 120 may be formed of expanded polystyrene, unlike the heat insulator formed of urethane. In this case, the heat insulator filled from the outside may fill the internal space of the partition 100 other than a portion occupied by the heat insulating member 120. Accordingly, even if a temperature difference occurs between the two storage compartments partitioned by the partition 100, the heat insulating member 120 and the heat insulator prevent heat from being excessively transferred between the two storage compartments. Therefore, it is possible to secure thermal insulation performance.

Although the preferred embodiments of the disclosure have been illustrated and described above, the disclosure is not limited to the specific embodiments as described above, and various modifications may be made by those skilled in the art without departing from the gist of the disclosure as claimed in the appended claims. Such modifications should not be individually understood from the technical spirit or prospect of the disclosure.

Although the present disclosure has been described with various embodiments, various changes and modifications may be suggested to one skilled in the art. It is intended that the present disclosure encompass such changes and modifications as fall within the scope of the appended claims.

What is claimed is:

1. A refrigerator comprising:

an outer case forming an exterior of the refrigerator;

an inner case disposed inside the outer case, forming a storage compartment therein, and including a communication hole formed through a side surface thereof;

a partition supported by the inner case and configured to partition the storage compartment, and including a heat insulator inlet at a position aligned with the communication hole; and a heat insulator filled between the outer case and the inner case and filled into the partition through the heat insulator inlet, wherein the partition includes a first vertical partitioning wall disposed between the outer case and the inner case and having a height to limit a size of the heat insulator inlet, wherein the partition further includes a second protrusion protruding horizontally from a side surface thereof through the communication hole, and disposed above the first vertical partitioning wall to form the heat insulator inlet together with the first vertical partitioning wall, wherein the partition further includes a support rib protruding downward from the second protrusion to support an inner surface of the first vertical partitioning wall, and wherein the support rib includes a plurality of support ribs spaced apart from each other along a thickness direction of the second protrusion.

2. The refrigerator as claimed in claim 1, wherein the size of the heat insulator inlet is in inverse proportion to the height of the first vertical partitioning wall.

3. The refrigerator as claimed in claim 1, wherein a thickness of a first portion of the heat insulator disposed between the first vertical partitioning wall and the outer case is smaller than a thickness of a second portion of the heat insulator disposed between the outer case and the inner case.

4. The refrigerator as claimed in claim 1, wherein:

the partition includes a first protrusion protruding horizontally from a side surface thereof through the communication hole to connect to a lower end of the first vertical partitioning wall, and the first vertical partitioning wall is formed to extend upward from the first protrusion, with a free end at an upper end thereof.

5. The refrigerator as claimed in claim 4, wherein the partition further includes a second vertical partitioning wall disposed on an opposite side of the communication hole from the first vertical partitioning wall to correspond to an upper area of the heat insulator inlet, with a free end at a lower end thereof.

6. The refrigerator as claimed in claim 5, wherein a lower end portion of the second vertical partitioning wall extends past an upper end portion of the first vertical partitioning wall in a vertical direction.

7. The refrigerator as claimed in claim 6, wherein the lower end portion of the second vertical partitioning wall extends past the upper end portion of the first vertical partitioning wall by 2 mm or more.

8. The refrigerator as claimed in claim 1, wherein the partition includes:

a lower cover including the first vertical partitioning wall; and an upper cover forming an internal space of the partition together with the lower cover.

9. The refrigerator as claimed in claim 8, wherein the partition further includes a reinforcing member coupled to the lower cover and the upper cover, the reinforcing member including a second vertical partitioning wall with a free end at a lower end thereof on an opposite side of the heat insulator inlet from the first vertical partitioning wall.

10. The refrigerator as claimed in claim 9, wherein the reinforcing member is disposed to surround a partial portion of side surfaces of the upper cover and the lower cover around the heat insulator inlet to connect the upper cover and the lower cover to each other.

11. The refrigerator as claimed in claim 10, wherein the reinforcing member includes a through hole at a position corresponding to the communication hole.

12. The refrigerator as claimed in claim 8, wherein the partition further includes a heat insulating member disposed between the upper cover and the lower cover.

13. The refrigerator as claimed in claim 12, wherein the heat insulating member is formed of expanded polystyrene.

14. The refrigerator as claimed in claim 13, wherein the heat insulator is formed of urethane.

15. A refrigerator comprising:

an outer case forming an exterior of the refrigerator;

an inner case disposed inside the outer case, forming a storage compartment therein, and including a communication hole formed through a side surface thereof; and a partition supported by the inner case and configured to partition the storage compartment, and including a heat insulator inlet at a position aligned with the communication hole, wherein the partition includes a first vertical partitioning wall disposed between the outer case and the inner case and having a height to limit a size of the heat insulator inlet, wherein the partition further includes a second protrusion protruding horizontally from a side surface thereof through the communication hole, and disposed above the first vertical partitioning wall to form the heat insulator inlet together with the first vertical partitioning wall, wherein the partition further includes a support rib protruding downward from the second protrusion to support an inner surface of the first vertical partitioning wall, and wherein the support rib includes a plurality of support ribs spaced apart from each other along a thickness direction of the second protrusion.

16. The refrigerator as claimed in claim 15, wherein the size of the heat insulator inlet is in inverse proportion to the height of the first vertical partitioning wall.

17. The refrigerator as claimed in claim 15, wherein:

the partition includes a first protrusion protruding horizontally from a side surface thereof through the communication hole to connect to a lower end of the first vertical partitioning wall, and the first vertical partitioning wall is formed to extend upward from the first protrusion, with a free end at an upper end thereof.

* * * * *